US006404149B1

(12) United States Patent
Ueno et al.

(10) Patent No.: US 6,404,149 B1
(45) Date of Patent: Jun. 11, 2002

(54) CATHODE RAY TUBE APPARATUS

(75) Inventors: Hirofumi Ueno; Tsutomu Takekawa, both of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/512,458

(22) Filed: Feb. 24, 2000

(30) Foreign Application Priority Data

Feb. 26, 1999 (JP) ..... 11-051476

(51) Int. Cl.[7] ..... G09G 1/04

(52) U.S. Cl. ..... 315/382; 315/15; 315/368.11; 313/412; 313/414; 313/437; 313/449

(58) Field of Search ..... 315/1, 15, 368.11, 315/382, 382.1, 364; 313/412, 414, 413, 415, 421, 437, 447, 453, 449

(56) References Cited

U.S. PATENT DOCUMENTS 4,967,120 A * 10/1990 Katsuma et al. ..... 313/414
5,449,983 A * 9/1995 Sugawara et al. ..... 313/414
5,744,917 A * 4/1998 Kawaharada ..... 313/414
5,936,338 A * 8/1999 Takahashi ..... 313/412

FOREIGN PATENT DOCUMENTS

JP 10-64446 3/1998

* cited by examiner

*Primary Examiner*—Haissa Philogene
(74) *Attorney, Agent, or Firm*—Oblon, Spivak, McClelland, Maier & Neustadt, P.C.

(57) ABSTRACT

An electron gun assembly forms an electron beam generator, pre-focusing lens, sub-lens, and main lens. The sub-lens has a weaker horizontal focusing power than the vertical one, and the main lens has a stronger horizontal focusing power than the vertical one. When the electron beam is not deflected, a first quadrupole lens is formed between the pre-focusing lens and sub-lens, and a second quadrupole lens is formed between the sub-lens and-main lens. At least one grid forming each of the first and second quadrupole lenses receives a dynamic focusing voltage which parabolically changes in synchronism with the deflection magnetic field and becomes higher when the electron beam is deflected than when it is not deflected.

11 Claims, 6 Drawing Sheets

CATHODE RAY TUBE APPARATUS

CROSS-REFERENCE TO RELATED APPLICATION

This application is based upon and claims the benefit of priority from the prior Japanese Patent Application No. 11-051476, filed Feb. 26, 1999, the entire contents of which are incorporated herein by reference.

BACKGROUND OF THE INVENTION

The present invention relates to a cathode ray tube apparatus and, more particularly, to a color cathode ray tube apparatus which reduces the elliptic distortion of an electron beam spot shape at the periphery of a phosphor screen and stably provides a good image quality.

In general, a color cathode ray tube apparatus comprises an in-line type electron gun assembly for emitting three electron beams horizontally in a line, i.e., a center beam and a pair of side beams that pass through the same horizontal plane, and a deflection yoke for generating a nonuniform deflection magnetic field for deflecting the three electron beams horizontally and vertically. This nonuniform deflection magnetic field is formed from a pincushion type horizontal deflection magnetic field and barrel type vertical deflection magnetic field. Three electron beams emitted by the electron gun assembly are focused on corresponding phosphor layers on the phosphor screen by a nonuniform deflection magnetic field generated by the deflection yoke while they undergo self-convergence as they travel toward the phosphor screen. Then, a color image is displayed on the phosphor screen.

As the electron gun assembly for emitting three electron beams, an electron gun assembly of a QPF (Quadru-Potential Focus) dynamic astigmatism correction and focus type comprises an array of three cathodes K, and first to sixth grids G1 to G6 which are sequentially laid out toward the phosphor screen and integrally supported, as shown in FIG. 4. Each of the grids G1 to G6 has three electron beam apertures corresponding to the three aligned cathodes K.

In this electron gun assembly, each cathode K receives a voltage of about 150 V, and the first grid G1 is grounded. The second grid G2 is connected to the fourth grid G4 in the tube, and receives a voltage of about 700 V. The third grid G3 is connected to a (5-1)th grid G5-1 in the tube, and receives a voltage of about 6 kV. A (5-2)th grid G5-2 receives a voltage of about 6 kV. The sixth grid G6 receives a high voltage of about 26 kV.

These voltages are applied to the cathodes and grids to form an electron beam generator 8, pre-focusing lens 9, UPF (Uni-Potential Focus) type sub-lens 10, and BPF (Bi-Potential Focus) type main lens 11.

The electron beam generator 8 is made up of the cathodes K, and first and second grids G1 and G2, generates an electron beam, and forms an object point with respect to the main lens 11. The pre-focusing lens 9 is made up of the second and third grids G2 and G3, and preliminarily focuses the electron beam emitted by the triode 8. The sub-lens 10 is made up of the third, fourth, and (5-1)th grids G3, G4, and G5-1, and further preliminarily focuses the electron beam which was preliminarily focused by the pre-focusing lens 9. The main lens 11 is made up of the (5-2)th and sixth grids G5-2 and G6, and finally focuses the preliminarily focused electron beam on the phosphor screen. Note that a lens including the sub-lens 10 and main lens 11 will be called a main lens system 13.

In deflecting an electron beam to the periphery of the phosphor screen by a nonuniform magnetic field generated by the deflection yoke, the (5-2)th grid G5-2 receives a voltage set in advance in accordance with the deflection distance. This voltage parabolically changes depending on the electron beam deflection amount such that the voltage minimizes when the electron beam is focused on the center of the phosphor screen, and maximizes when the electron beam is deflected and focused on the corners of the phosphor screen.

When the electron beam is deflected to a corner of the phosphor screen, the potential difference between the (5-2)th and sixth grids G5-2 and G6 becomes smallest, and the lens power of the main lens 11 becomes weakest. At the same time, the (5-1)th and (5-2)th grids G5-1 and G5-2 form a potential difference to form a quadrupole lens 12. The quadrupole lens 12 formed at this time has the highest lens power because of the largest potential difference between the grids G5-1 and G5-2. The quadrupole lens 12 is set to achieve horizontal focusing action and vertical divergent action.

As the electron beam is deflected to increase the distance from the electron gun assembly to the phosphor screen, and set the object point apart, the main lens power weakens. At the same time, a quadrupole lens 12 for compensating for a deflection error caused by the horizontal and vertical deflection magnetic fields of the deflection yoke is generated. The lens power of the quadrupole lens 12 increases depending on the deflection amount.

To improve the image quality of the color cathode ray tube apparatus, the focusing characteristic on the phosphor screen must be improved. Particularly in a color cathode ray tube which incorporates an electron gun assembly for emitting three electron beams in a line, the beam spot on the phosphor screen generates an elliptic distortion core 1 and blur 2 owing to the deflection error, as shown in FIG. 5A.

In general, as shown in FIG. 5B, the blur 2 can be prevented according to the deflection error compensation method by constituting a low-voltage electrode forming a main lens by a plurality of grids such as the (5-1)th and (5-2)th grids G5-1 and G5-2, and generating a quadrupole lens in accordance with deflection of the electron beam between these grids, like a dynamic astigmatism correction and focus type electron gun assembly. However, as shown in FIG. 5B, the elliptic distortion of a horizontally expanded beam spot still remains at the ends of the horizontal and diagonal axes of the phosphor screen. This elliptic distortion generates moire or the like due to interference with a shadow mask, which makes it difficult to see, e.g., a character formed by an electron beam spot.

The elliptic distortion of the beam spot will be explained using an optical lens model.

FIG. 6A shows a lens model in a no-deflection state in which an electron beam is focused on the center of the phosphor screen without any deflection. FIG. 6B shows a lens model in a deflection state in which an electron beam is deflected and focused on the periphery of the phosphor screen.

The beam spot size on a phosphor screen SCN depends on a magnification M. Let Mh be the horizontal magnification of the electron beam, and Mv be the vertical magnification. Then, M can be given by $$M = \text{Divergent Angle } \alpha o / \text{Incident Angle } \alpha i$$

That is, $Mh$ (Horizontal Magnification)=$\alpha oh$ (Horizontal Divergent Angle)/$\alpha ih$ (Horizontal Incident Angle)

$Mv$ (Vertical Magnification)=$\alpha ov$ (Vertical Divergent Angle)/$\alpha iv$ (Vertical Incident Angle)

For $\alpha oh=\alpha ov$, when the electron beam is not deflected as shown in FIG. 6A, the electron beam is influenced by almost the same focusing action both in horizontal and vertical directions H and V by the sub-lens 10 and main lens 11. This yields $\alpha ih=\alpha iv$ and Mh=Mv.

When the electron beam is deflected as shown in FIG. 6B, the quadrupole lens 12 having divergent action in the vertical direction V and focusing action in the horizontal direction H is formed between the sub-lens 10 and main lens 11 so as to compensate for the influence of a deflection error 14 having focusing action in the vertical direction V and divergent action in the horizontal direction H. This yields $\alpha ih<\alpha iv$ and Mv<Mh.

As a result, the beam spot shape of the electron beam becomes circular at the center of the phosphor screen, but is horizontally elongated at the periphery of the phosphor screen.

To prevent this, an electron gun assembly having a so-called double quadrupole structure is proposed. As shown in FIG. 12, this electron gun assembly has almost the same structure as that shown in FIG. 4 except that the third grid G3 is made up of (3-1)th and (3-2)th grids G3-1 and G3-2. The (3-2)th grid G3-2 is connected to a (5-2)th grid G5-2, and receives a parabolic voltage when the electron beam is deflected. This applied voltage forms a quadrupole lens 14 which dynamically changes in synchronism with the deflection magnetic field, between the (3-1)th and (3-2)th grids G3-1 and G3-2 when the electron beam is deflected.

The double quadrupole type electron gun assembly will be explained using an optical lens model.

FIG. 7A shows a lens model when the electron beam is not deflected, and FIG. 7B shows a lens model when the electron beam is deflected.

For $\alpha oh=\alpha ov$, when the electron beam is not deflected as shown in FIG. 7A, the electron beam is influenced by almost the same focusing action both in the horizontal and vertical directions H and V by the sub-lens 10 and main lens 11. This results in $\alpha ih=\alpha iv$ and Mh=Mv. Hence, a circular beam spot can be formed at the center of the phosphor screen SCN.

When the electron beam is deflected as shown in FIG. 7B, a first quadrupole lens 12A is formed on the cathode side of the sub-lens 10, and a second quadrupole lens 12B is formed between the sub-lens 10 and main lens 11. The first quadrupole lens 12A has focusing action in the vertical direction V and divergent action in the horizontal direction H. The second quadrupole lens 12B has divergent action in the vertical direction V and focusing action in the horizontal direction H.

This results in $\alpha ih=\alpha iv$ and Mh=Mv. In the theory of magnification, a circular beam spot can be formed even at the periphery of the phosphor screen.

However, in this double quadrupole type electron gun assembly, a bundle of electron beams in passing through the main lens 11 have a large horizontal diameter, and are readily influenced by the spherical aberration of the main lens 11. To efficiently operate the double quadrupole lenses, the strong horizontal divergent action and vertical focusing action of the first quadrupole lens 12A and the strong horizontal focusing action and vertical divergent action of the second quadrupole lens 12B must be combined. However, the combination of two quadrupole lenses having strong lens powers increases the spherical aberration of the main lens to inhibit the beam spot shape from becoming circular at the periphery of the phosphor screen SCN.

To reduce the spherical aberration of the main lens caused by the double quadrupole type electron gun assembly, the divergent angle $\alpha o$ is effectively set sufficiently small. When the divergent angle $\alpha o$ is small, the diameter of the virtual object point of the electron beam generally increases. Even if the double quadrupole type electron gun assembly can form a circular electron beam spot on the entire phosphor screen SCN, the beam spot enlarges, resulting in poor image quality.

To prevent the beam spot from enlarging, it is effective to set a small magnification M for the main lens system made up of the sub-lens and main lens. In the QPF type electron gun assembly constituting the main lens system, a main lens system having a large magnification M is formed by giving the sub-lens 10 a strong focusing power and the main lens 11 a weak focusing power, as shown in FIG. 8A. Moreover, a main lens system having a small magnification M is formed by giving the sub-lens 10 a weak focusing power and the main lens 11 a strong focusing power, as shown in FIG. 8B.

By changing the balance between the sub-lens and main lens, the magnification M of the lens system can be decreased relatively easily.

More specifically, a circular beam spot can be formed on the entire phosphor screen by operating the main lens system having a small magnification M, the electron beam having a small divergent angle, and the double quadrupole lenses made of strong quadrupole lenses.

However, in the main lens system having a small magnification, the beam spot diameter, i.e., spot size on the phosphor screen readily changes upon a change in focusing voltage Vf applied to the (3-2)th and (5-2)th grids G3-2 and G5-2. In the main lens system having a small magnification, as shown in FIG. 8B, the beam spot diameter steeply changes with respect to the focusing voltage Vf. This phenomenon appears in an image as degradation of the focusing characteristic when the parabolic voltage applied to the (5-2)th and (3-2)th grids G5-2 and G3-2 deviates from a predetermined voltage. Thus, an accurate external application voltage must be applied, which makes it difficult to design the driver of such color cathode ray tube apparatus, and increases its cost.

As described above, to improve the image quality of the color cathode ray tube apparatus, it is necessary to maintain a good focusing state on the entire phosphor screen and suppress the elliptic distortion of the electronic beam spot. In the conventional QPF dynamic astigmatism correction and focus type electron gun assembly, a proper parabolic voltage is applied to the low-voltage electrode of the main lens to change the lens power of the main lens and form a quadrupole lens which dynamically changes. This prevents generation of the vertical blur of an electron beam caused by the deflection error.

However, the elliptic distortion of the beam spot at the periphery of the phosphor screen is conspicuous. The double quadrupole method adopted to reduce the elliptic distortion of the beam spot can form a circular beam spot on the entire screen. To efficiently operate the double quadrupole lenses, an electron beam having a small divergent angle must land on the phosphor screen. Further, a main lens system having a small magnification M must be constituted.

In an electron gun assembly having the main lens system with a small magnification M, the beam spot diameter on the phosphor screen greatly changes upon a change in focusing voltage Vf. When the parabolic voltage applied outside the color cathode ray tube deviates from a predetermined voltage, the image degrades remarkably. A circuit for driving the color cathode ray tube is difficult to design, and its cost increases.

BRIEF SUMMARY OF THE INVENTION

The present invention has been made to overcome the conventional drawbacks, and has as its object to provide a cathode ray tube apparatus having stable performance of suppressing the elliptic distortion of a beam spot on the entire phosphor screen and obtaining a good focusing characteristic on the entire phosphor screen.

To achieve the above objects, according to the present invention, there is provided a cathode ray tube apparatus comprising an electron gun assembly which has a cathode and a plurality of grid electrodes sequentially laid out from the cathode toward a phosphor screen, and emits an electron beam, and a deflection device for forming a deflection magnetic field for horizontally and vertically deflecting the electron beam emitted by the electron gun assembly, the electron gun assembly including an electron beam generator for generating an electron beam, a pre-focusing lens for preliminarily focusing the electron beam emitted by the electron beam generator, a sub-lens which has lens action with a weaker horizontal focusing power than a vertical focusing power, and further preliminarily focuses the electron beam which was preliminarily focused by the pre-focusing lens, a main lens which has lens action with a stronger horizontal focusing power than a vertical focusing power, and focuses the electron beam preliminarily focused by the sub-lens on the phosphor screen, and voltage application means for applying to each grid electrode of the electron gun assembly a voltage which forms first and second multipole lenses between the pre-focusing lens and the main lens when the electron beam emitted by the electron gun assembly is not deflected and is focused on a center of the phosphor screen, and weakens lens actions of the first and second multipole lenses with an increase in electron beam deflection amount when the electron beam is deflected.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 2A to 2C are views schematically showing the structure of the fourth grid of the electron gun assembly shown in FIG. 1, in which FIG. 2A is a font view when viewed from the phosphor screen side, FIG. 2B is a side view when viewed from the side, and FIG. 2C is a plan view when viewed from the top;

DETAILED DESCRIPTION OF THE INVENTION

A color cathode ray tube apparatus according to an embodiment of the present invention will be described below with reference to the several views of the accompanying drawing.

Figure 3:
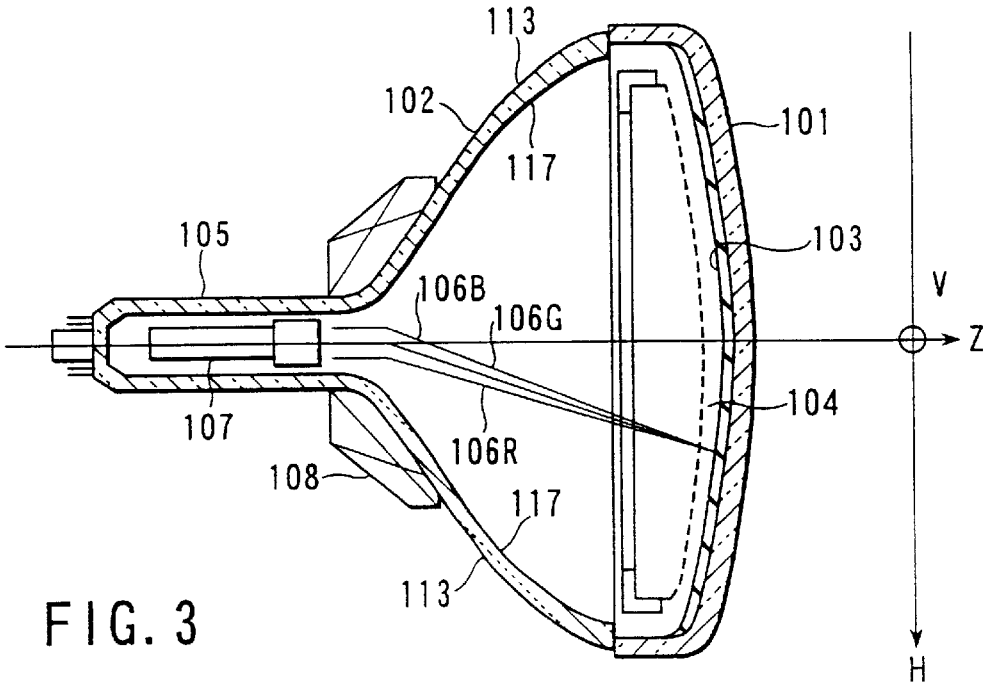
FIG. 3 is a horizontally sectional view schematically showing the structure of a cathode ray tube according to an embodiment of the present invention.
Figure 4:
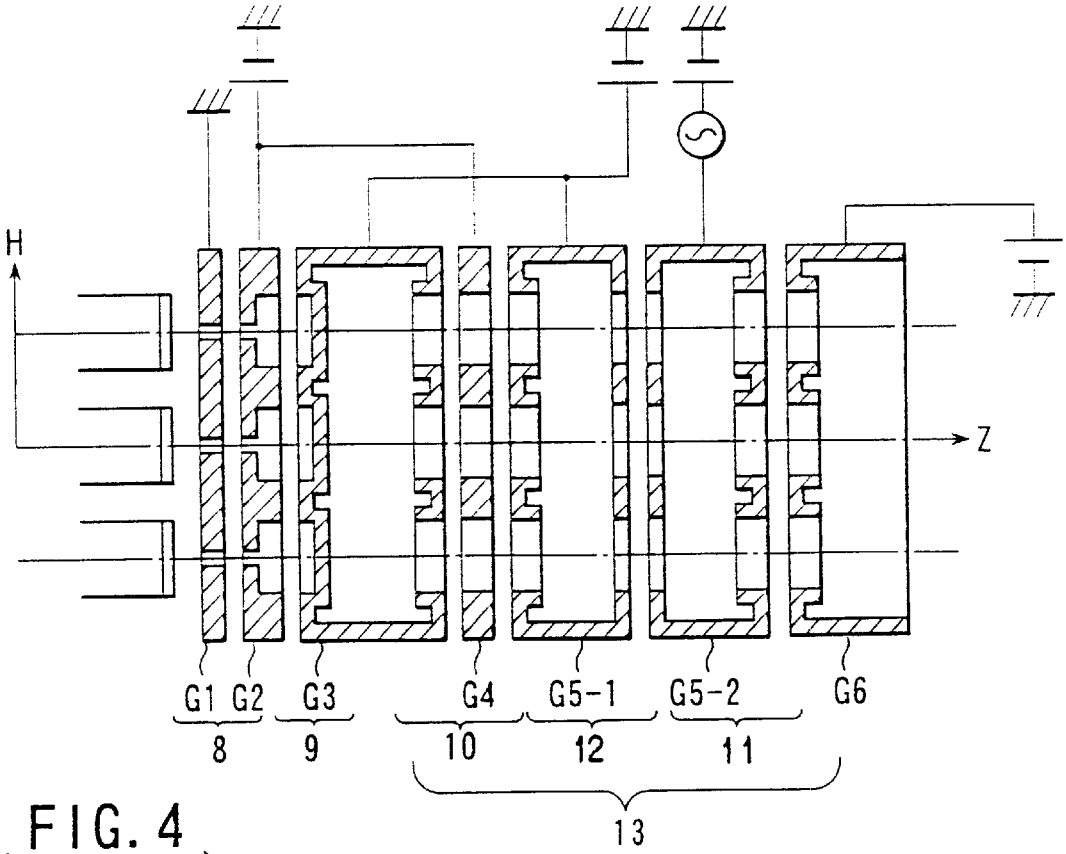
FIG. 4 (PRIOR ART)
FIG. 4 is a horizontally sectional view schematically showing the arrangement of a conventional electron gun assembly.
Figure 5A:
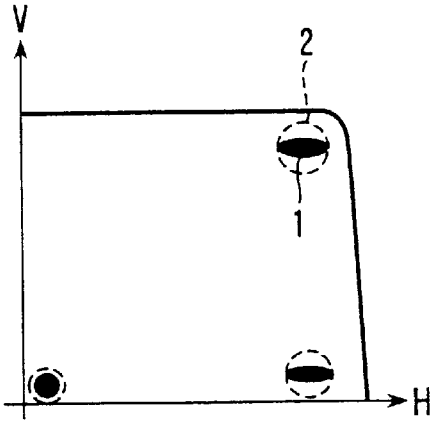
FIG. 5A (PRIOR ART)
FIG. 5A is a view for explaining a blur generated in a beam spot on the phosphor screen in the conventional electron gun assembly.
Figure 5B:
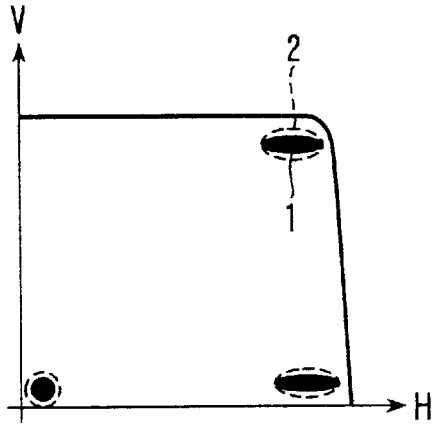
FIG. 5B (PRIOR ART)
FIG. 5B is a view for explaining elliptic distortion generated in the beam spot on the phosphor screen in the conventional electron gun assembly.
Figure 6A:
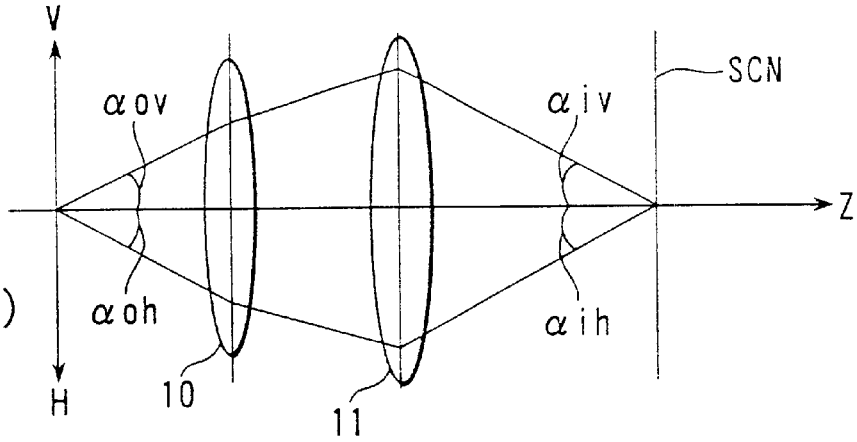
FIG. 6A (PRIOR ART)
FIGS. 6A and 6B are views showing the optical lens models of the conventional electron gun assembly when the electron beam is not deflected and is deflected, respectively.
Figure 6B:
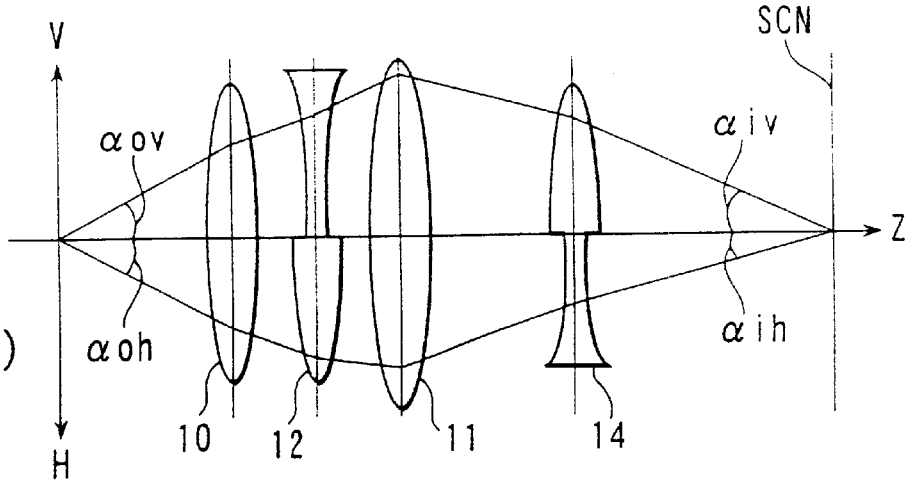
FIG. 6B (PRIOR ART)
Figure 7A:
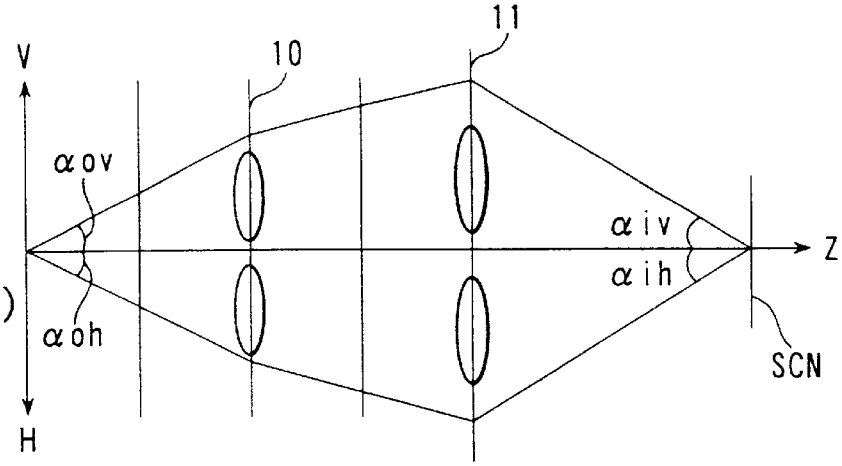
FIG. 7A (PRIOR ART)
FIGS. 7A and 7B are views showing the optical lens models of an electron gun assembly adopting a conventional double quadrupole lens method when the electron beam is not deflected and is deflected, respectively.
Figure 7B:
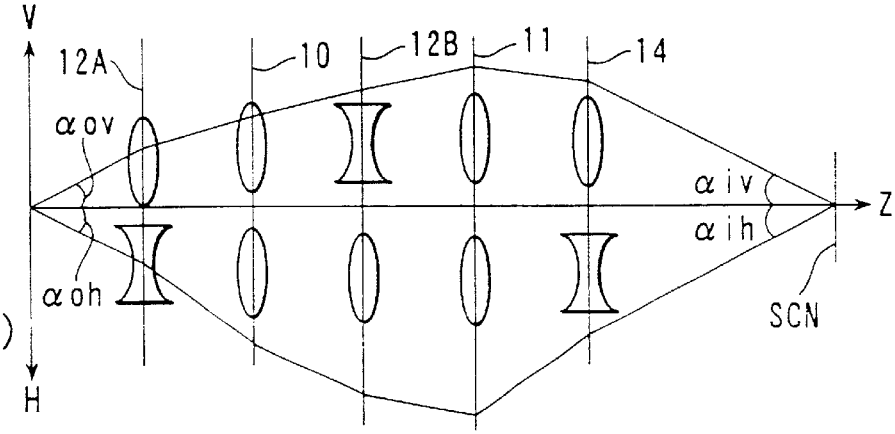
FIG. 7B (PRIOR ART)

As shown in FIG. 3, this color cathode ray tube apparatus is a so-called in-line type color cathode ray tube apparatus having an in-line type electron gun assembly for emitting three electron beams in a line in a horizontal direction H.

The in-line type color cathode ray tube apparatus has an envelope made up of a panel 101, neck 105, and funnel 102 which connects the panel 101 and neck 105.

The panel 101 is almost rectangular and has on its inner surface a phosphor screen 103 (target) formed from striped or dot-like phosphor or metal back layers of three colors for emitting red (R), green (G), and blue (B) beams. The color cathode ray tube apparatus has a shadow mask 104 formed at a position where it faces the phosphor screen 103 with a predetermined interval. The shadow mask 104 includes many apertures for passing an electron beams.

The neck 105 is formed into an almost cylindrical shape having a central axis which coincides with the tube axis. The inner shape of the neck 105 also has an almost circular sectional shape. The neck 105 incorporates an electron gun assembly 107, i.e., so-called in-line type electron gun assembly for emitting three electron beams 106B, 106G, and 106R in a line that passes through the same horizontal plane.

The three electron beams 106G, 106B, and 106R are generated in a line in the horizontal direction H, and emitted along a direction parallel to a tube axis direction Z. Of the three electron beams, the electron beam 106G as a center beam propagates along an orbit nearest to the central axis of the neck 105. The electron beams 106B and 106R as a pair of side beams propagate along orbits on the two sides of the center beam 106G.

The electron gun assembly 107 focuses the three electron beams 106R, 106G, and 106B on corresponding phosphor layers on the surface of the phosphor screen 103, and at the same time converges them on the surface of the phosphor screen 103.

The color cathode ray tube apparatus comprises a deflection device 108 mounted outside the funnel 102, outer conductive film 113 formed on the outer surface of the funnel 102, and inner conductive film 117 formed on the inner surface from the funnel 102 to part of the neck 105. The inner conductive film 117 is electrically connected to an anode terminal for supplying an anode voltage.

In the color cathode ray tube apparatus with this structure, the three electron beams 106B, 106G, and 106R emitted by the electron gun assembly 107 are deflected by a nonuniform magnetic field formed from a pincushion type horizontal deflection magnetic field and barrel type vertical deflection magnetic field generated by the deflection device 108 as they undergo self-convergence. These electron beams 106B, 106G, and 106R scan the phosphor screen 103 through the shadow mask 104 in the horizontal and vertical directions H and V. Then, a color image is displayed.

Figure 1:
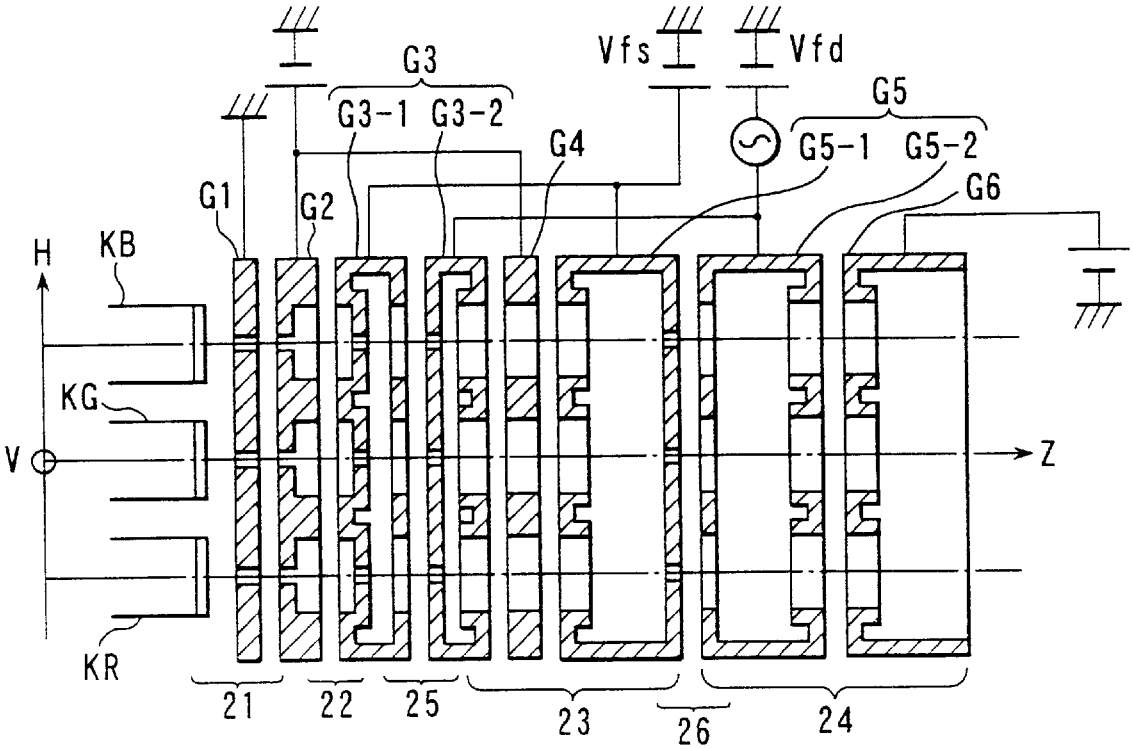
FIG. 1 is a horizontally sectional view schematically showing the structure of an in-line type electron gun assembly applied to a cathode ray tube according to the present invention.

As shown in FIG. 1, the electron gun assembly 107 applied to the color cathode ray tube apparatus has three cathodes K (B, G, and R) aligned in the horizontal direction H, three heaters (not shown) for separately heating these cathodes K, and first to sixth grids G1 to G6 sequentially laid out in the tube axis direction Z from the cathodes K toward the phosphor screen 103. The cathodes K, heaters, and grids G1 to G6 are integrally supported by a pair of insulating supports.

The third grid G3 is made up of at least two segments, i.e., a first segment G3-1 near the second grid G2 and second segment G3-2 near the fourth grid G4, as shown in FIG. 1. The fifth grid G5 is made up of at least two segments, i.e., a first segment G5-1 near the fourth grid G4 and second segment G5-2 near the sixth grid G6, as shown in FIG. 1.

The first and second grids G1 and G2 are plate-like electrodes. The plate surface of each grid has three electron beam apertures in an almost circular shape in correspondence with the three cathodes K aligned in the horizontal direction H.

The first and second segments G3-1 and G3-2 of the third grid G3 are cylindrical electrodes. Each of the two end faces on the cathode K side and phosphor screen side of the respective electrodes has three electron beam apertures in correspondence with the three cathodes K. That surface of the first segment G3-1, which faces the second segment G3-2 has noncircular electron beam apertures having a major axis in the horizontal direction H. That surface of the second segment G3-2, which faces the first segment G3-1 has noncircular electron beam apertures having a major axis in the vertical direction V.

Figure 2A:
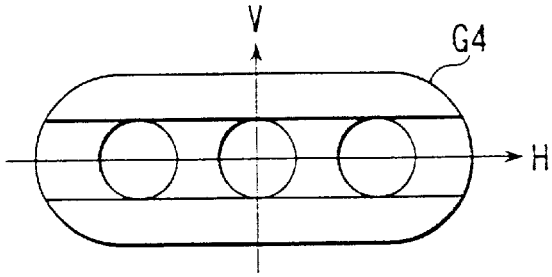
Figure 2B:
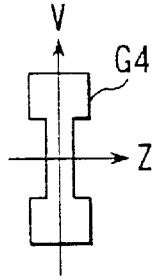
Figure 2C:
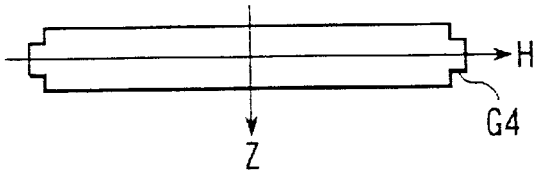

The fourth grid G4 is a plate-like electrode, and its plate surface has three electron beam apertures in an almost circular shape. As shown in FIG. 2, the fourth grid G4 is made thicker in the vertical direction V of the electron beam aperture than in the horizontal direction H. That is, the fourth grid G4 partially projects to sandwich the three electron beam apertures aligned in the horizontal direction H.

The first and second segments G5-1 and G5-2 of the fifth grid G5 are cylindrical electrodes. Each of the two end faces on the cathode K side and phosphor screen side of the respective electrodes has three electron beam apertures in correspondence with the three cathodes K. That surface of the first segment G5-1, which faces the second segment G5-2 has noncircular electron beam apertures having a major axis in the vertical direction V. That surface of the second segment G5-2, which faces the first segment G5-1 has noncircular electron beam apertures having a major axis in the horizontal direction H. Further, that surface of the second segment G5-2, which faces the sixth grid G6 has noncircular electron beam apertures having a major axis in the vertical direction.

The sixth grid G6 is a cup-like electrode. The bottom surface of the sixth grid G6 on the cathode side has three electron beam apertures in correspondence with the three cathodes, and the surface on the phosphor screen side has an opening common to three electron beams.

In this electron gun assembly, the cathodes and grids receive the following voltages.

More specifically, each cathode K receives a voltage of 100 to 150 V. The first grid G1 is grounded. The second grid is connected to the fourth grid G4, and the second and fourth grids receive a voltage of 400 to 800 V.

The first segment G3-1 of the third grid G3 is connected to the first segment G5-1 of the fifth grid G5, and the segments G3-1 and G5-1 receive a fixed voltage, i.e., focusing voltage Vfs of 6 to 8 kV.

The second segment G3-2 of the third grid G3 is connected to the second segment G5-2 of the fifth grid G5, and the segments G3-2 and G5-2 receive a dynamic focusing voltage Vfd prepared by superposing on the fixed voltage of 6 to 8 kV a voltage which parabolically changes upon a change in electron beam deflection amount. This dynamic focusing voltage Vfd is smaller than the fixed focusing voltage Vfs (Vfs>Vfd) in a no-deflection state in which an electron beam emitted by the cathode is focused on the center of the phosphor screen, and is equal to the fixed focusing voltage Vfs (Vfs=Vfd) in a deflection state in which an electron beam emitted by the cathode is deflected and focused on the periphery of the phosphor screen.

The sixth grid G6 receives a high voltage, i.e., anode voltage of 26 to 27 kV.

By applying these voltages, the cathodes K, and first and second grids G1 and G2 form an electron beam generator, i.e., triode 21 for generating three electron beams and forming an object point with respect to a main lens (to be described later). The second and third grids G2 and G3 form a pre-focusing lens 22 for preliminarily focusing the three electron beams generated by the triode 21. The third, fourth, and fifth grids G3, G4, and G5 form a sub-lens 23 for further preliminarily focusing the three electron beams which were preliminarily focused by the pre-focusing lens 22. The fifth and sixth grids G5 and G6 form a main lens 24 for focusing the three electron beams preliminarily focused by the sub-lens 23 on the phosphor screen.

When the electron beam is not deflected, the first and second segments G3-1 and G3-2 of the third grid G3 form a potential difference to form a first quadrupole lens 25. The first quadrupole lens 25 has focusing action in the horizontal direction H and divergent action in the vertical direction V because of the presence of noncircular electron beam apertures formed in the facing surfaces of the first and second segments G3-1 and G3-2 of the third grid G3.

Simultaneously when the electron beam is not deflected, the first and second segments G5-1 and G5-2 of the fifth grid G5 form a potential difference to form a second quadrupole lens 26. The second quadrupole lens 26 has divergent action in the horizontal direction H and focusing action in the vertical direction V because of the presence of noncircular electron beam apertures formed in the facing surfaces of the first and second segments G5-1 and G5-2 of the fifth grid G5.

Figure 9A:
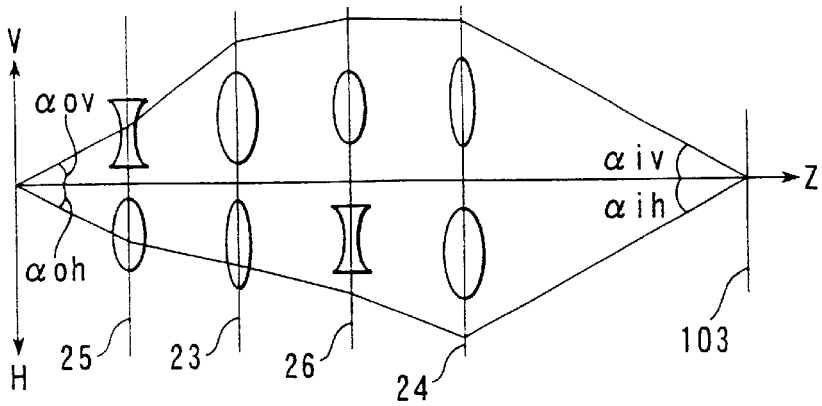
FIGS. 9A and 9B are views showing the optical lens models of an electron gun assembly applied to the cathode ray tube of the present invention when the electron beam is not deflected and is deflected, respectively.

In the electron gun assembly with this structure, a divergent angle $\alpha oh$ in the horizontal direction H is equal to a divergent angle $\alpha ov$ in the vertical direction V ($\alpha oh=\alpha ov$) when the electron beam is not deflected, as shown in FIG. 9A. At this time, the potential difference between the first and second segments G3-1 and G3-2 of the third grid G3 is maximum, and the lens action of the first quadrupole lens 25 is strongest. The first quadrupole lens 25 at this time exhibits focusing action in the horizontal direction H and divergent action in the vertical direction V. The focusing action of the sub-lens 23 in the vertical direction V is stronger than in the horizontal direction H. The potential difference between the first and second segments G5-1 and G5-2 of the fifth grid G5 is maximum, and the lens action of the second quadrupole lens 26 is strongest. The second quadrupole lens 26 at this time exhibits divergent action in the horizontal direction H and focusing action in the vertical direction V. The focusing action of the main lens 24 in the horizontal direction H is stronger than in the vertical direction V.

That is, when the electron beam is not deflected, the electron beam emitted by the cathode K of the triode 21 is preliminarily focused by the pre-focusing lens 22, and then influenced by focusing action in the horizontal direction H and divergent action in the vertical direction V by the first quadrupole lens 25.

Subsequently, the electron beam is influenced by relatively weak focusing action in the horizontal direction H and relatively strong focusing action in the vertical direction V by the sub-lens 23. This electron beam is influenced by divergent action in the horizontal direction H and focusing action in the vertical direction V by the second quadrupole lens 26. Finally, the electron beam is influenced by relatively strong focusing action in the horizontal direction H and relatively weak focusing action in the vertical direction V by the main lens 24, and focused on the center of the phosphor screen 103.

In this case, an incident angle $\alpha ih$ of the electron beam incident on the phosphor screen 103 in the horizontal direction H is equal to an incident angle $\alpha iv$ in the vertical direction V ($\alpha ih=\alpha iv$). For this reason, a magnification Mh ($=\alpha oh/\alpha ih$) in the horizontal direction H is equal to a magnification Mv ($=\alpha ov/\alpha iv$) in the vertical direction V (Mh=Mv). That is, a circular beam spot can be formed at the center of the phosphor screen 103.

Figure 9B:
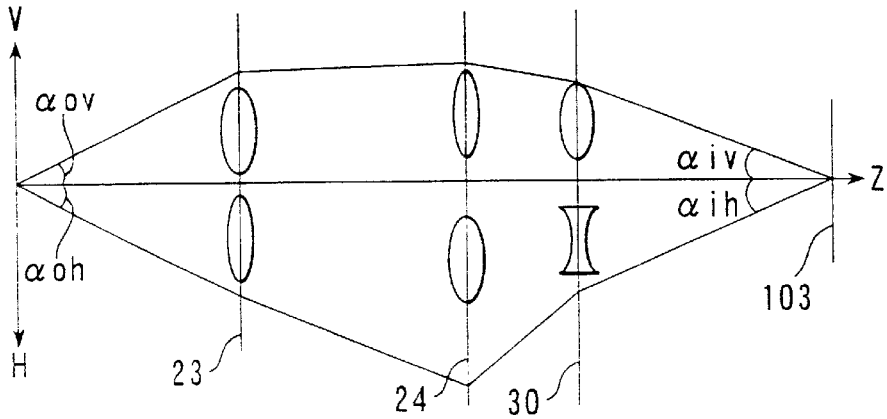

When the electron beam is deflected, as shown in FIG. 9B, the divergent angle $\alpha oh$ in the horizontal direction H is equal to the divergent angle $\alpha ov$ in the vertical direction V ($\alpha oh=\alpha ov$). As the electron beam deflection amount increases, the potential difference between the first and second segments G3-1 and G3-2 of the third grid G3 decreases. At a maximum deflection amount, the potential difference minimizes to 0. At this time, the first quadrupole lens 25 loses both focusing action in the horizontal direction H and divergent action in the vertical direction V. The focusing action of the sub-lens 23 in the vertical direction V is stronger than in the horizontal direction H. As the electron beam deflection amount increases, the potential difference between the first and second segments G5-1 and G5-2 of the fifth grid G5 decreases. At a maximum deflection amount, the potential difference minimizes to 0. At this time, the second quadrupole lens 26 loses both divergent action in the horizontal direction H and focusing action in the vertical direction V as in the first quadrupole lens 25. Since the fixed focusing voltage Vfs becomes equal to the dynamic focusing voltage Vfd (Vfs=Vfd), the first and second quadrupole lenses 25 and 26 are not formed. The focusing action of the main lens 24 in the horizontal direction H is stronger than in the vertical direction V.

That is, when the electron beam is deflected, the electron beam emitted by the cathode K of the triode 21 is preliminarily focused by the pre-focusing lens 22, and then influenced by weak focusing action in the horizontal direction H and strong focusing action in the vertical direction V by the sub-lens 23. The electron beam is influenced by strong focusing action in the horizontal direction H and weak focusing action in the vertical direction V by the main lens 24. Finally, the electron beam is influenced by a deflection error component 30 included in the nonuniform deflection magnetic field, influenced by divergent action in the horizontal direction H and focusing action in the vertical direction V, and focused on the phosphor screen 103. The influence of the deflection error component 30 on the electron beam is compensated by setting different focusing powers of the sub-lens 23 and main lens 24 in the horizontal and vertical directions H and V.

In this case, the incident angle $\alpha ih$ of the electron beam incident on the phosphor screen 103 in the horizontal direction H is equal to the incident angle $\alpha iv$ in the vertical direction V ($\alpha ih=\alpha iv$). Thus, a circular beam spot can be formed.

The divergent angle $\alpha oh$ in the horizontal direction H and the divergent angle $\alpha ov$ in the vertical direction V are sufficiently small, so that the electron beam is free from any influence of the spherical aberration of the main lens 24.

As described above, the color cathode ray tube apparatus according to this embodiment changes the lens power of the main lens in accordance with the electron beam deflection amount, and at the same time forms a quadrupole lens which dynamically changes. Consequently, generation of a vertical blur of an electron beam caused by the deflection error can be prevented.

The color cathode ray tube apparatus adopting the double quadrupole method can reduce the elliptic distortion of a beam spot and form an almost circular beam spot on the entire phosphor screen.

In this color cathode ray tube apparatus, the divergent angles $\alpha oh$ and $\alpha ov$ of the electron beam in the horizontal and vertical directions H and V are sufficiently small, and the electron beam is free from any influence of the spherical aberration of the main lens 24.

Figure 8A:
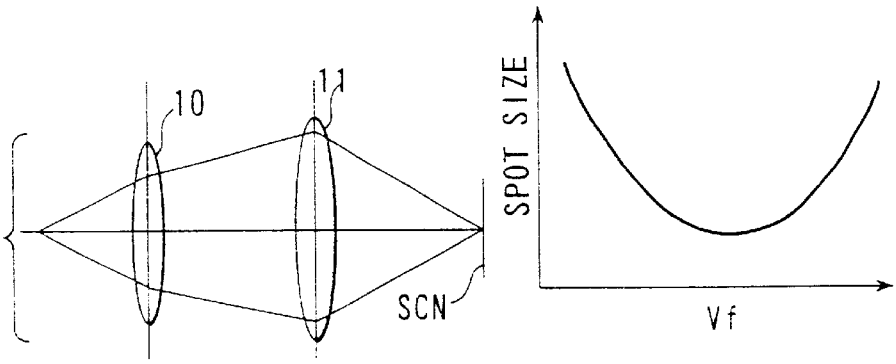
FIG. 8A (PRIOR ART)
FIGS. 8A and 8B are views each showing a change in spot size with respect to a focusing voltage Vf upon changing the balance between the lens powers of a sub-lens and main lens in a general QPF type electron gun assembly.
Figure 8B:
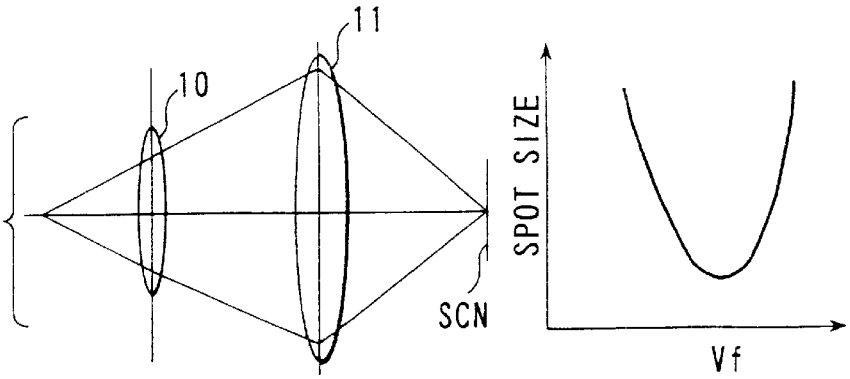
FIG. 8B (PRIOR ART)

In the color cathode ray tube apparatus, the sub-lens has a stronger vertical focusing power than the horizontal one. As shown in FIG. 8A, the electron beam spot on the phosphor screen hardly changes upon a change in focusing voltage Vf. Even if the parabolic focusing voltage Vfd applied outside the color cathode ray tube slightly deviates from a predetermined voltage, the beam spot diameter of an electron beam can hardly change to minimize degradation of the image quality.

Accordingly, the present invention can provide a color cathode ray tube apparatus having stable performance of suppressing the elliptic distortion of a beam spot on the entire phosphor screen and obtaining a good focusing characteristic on the entire phosphor screen.

Note that the color cathode ray tube apparatus of the present invention is not limited to the above-mentioned embodiment.

Figure 10:
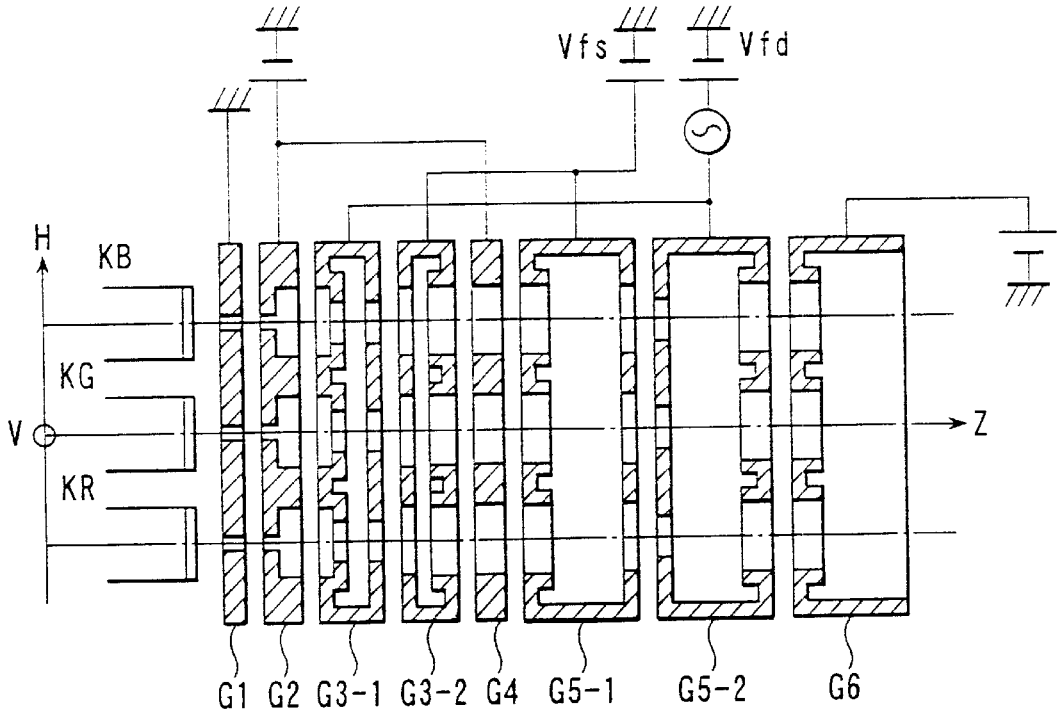
FIG. 10 is a horizontally sectional view schematically showing the structure of another electron gun assembly applicable to the cathode ray tube of the present invention.

For example, an electron gun assembly shown in FIG. 10 has the following structure. This electron gun assembly has the same basic structure as that of the above embodiment except that the first segment G3-1 of the third grid G3 is connected to the second segment G5-2 of the fifth grid G5, and the second segment G3-2 of the third grid G3 is connected to the first segment G5-1 of the fifth grid G5. In this case, that surface of the first segment G3-1 of the third grid G3, which faces the second segment G3-2 has noncircular electron beam apertures having a major axis in the vertical direction V. That surface of the second segment G3-2, which faces the first segment G3-1 has noncircular electron beam apertures having a major axis in the horizontal direction H.

By applying predetermined voltages to the grids of this structure, a first quadrupole lens having divergent action in the horizontal direction H and focusing action in the vertical direction V is formed between the first and second segments G3-1 and G3-2 of the third grid G3. A second quadrupole lens having focusing action in the horizontal direction H and divergent action in the vertical direction V is formed between the first and second segments G5-1 and G5-2 of the fifth grid G5.

This structure can obtain the same effects as those of the above embodiment.

Figure 11:
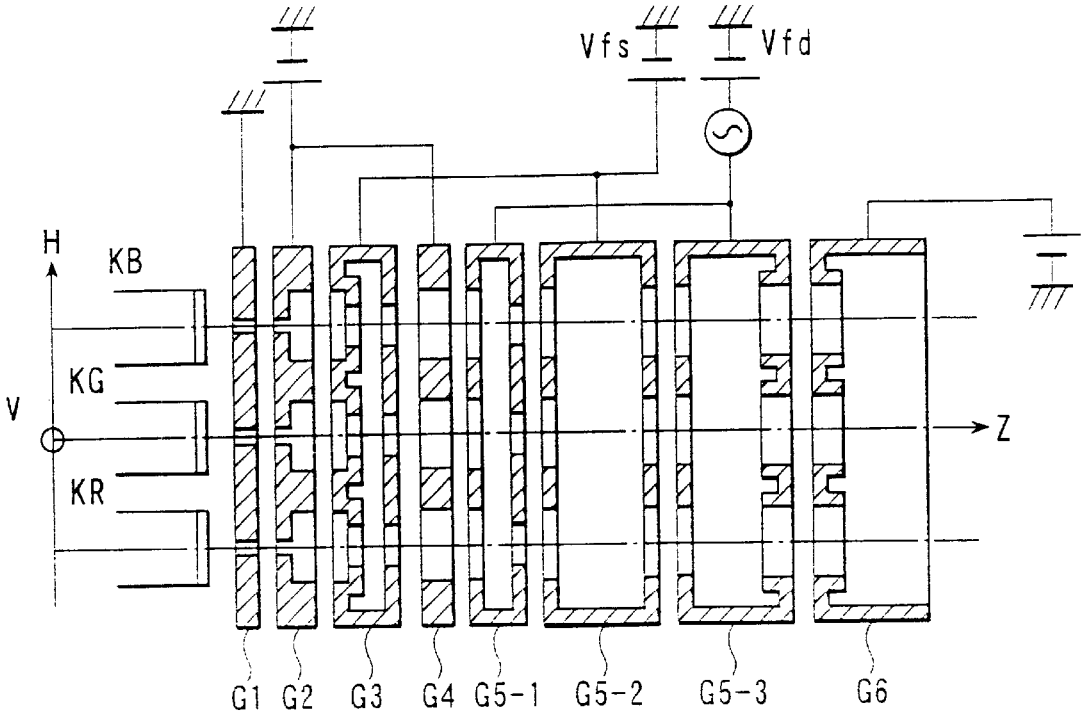
FIG. 11 is a horizontally sectional view schematically showing the structure of still another electron gun assembly applicable to the cathode ray tube of the present invention.
Figure 12:
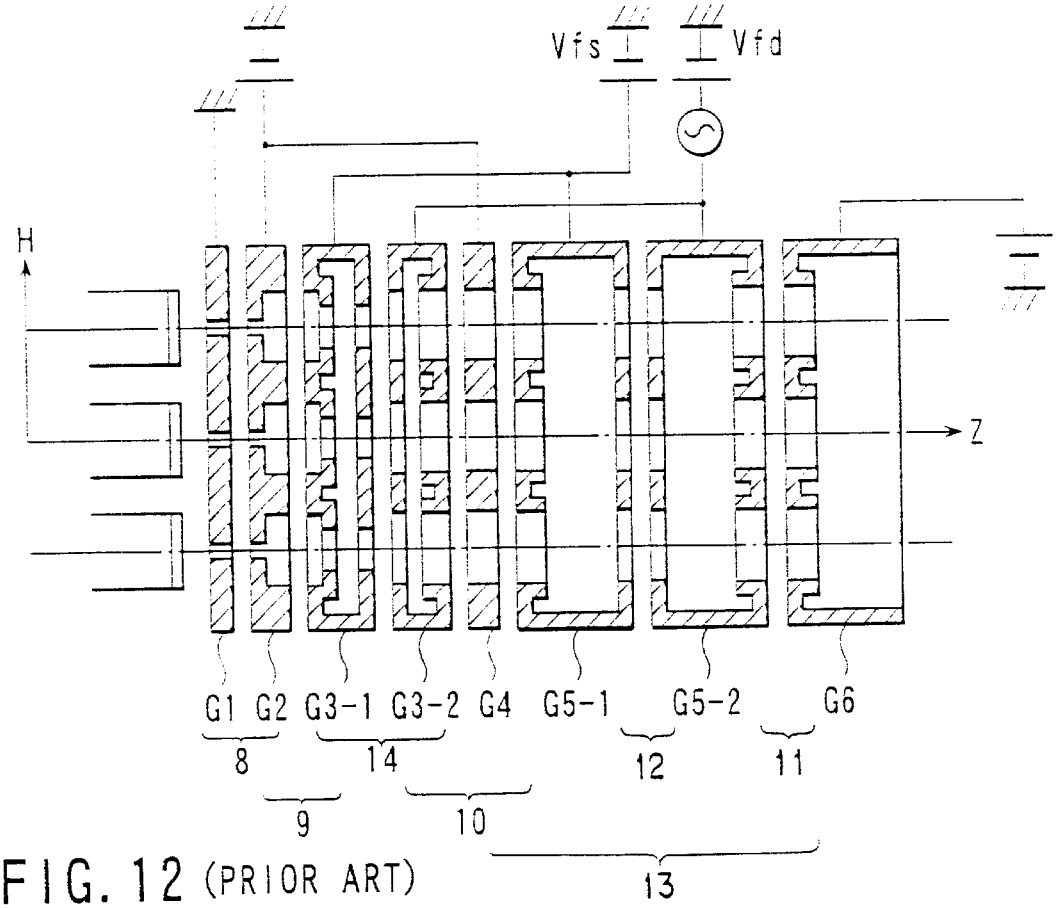
FIG. 12 (PRIOR ART)
FIG. 12 is a horizontally sectional view schematically showing the structure of a conventional electron gun assembly.

An electron gun assembly shown in FIG. 11 has the following structure. The third grid G3 is formed from one segment, whereas the fifth grid GS is made up of first, second, and third segments G5-1, G5-2, and G5-3.

That surface of the first segment GS-1 of the fifth grid G5, which faces the second segment G5-2 has noncircular electron beam apertures having a major axis in the vertical direction V. That surface of the second segment G5-2, which faces the first segment G5-1 has noncircular electron beam apertures having a major axis in the horizontal direction H.

The third grid G3 is connected to the second segment G5-2 of the fifth grid G5. The third grid G3 and second segment G5-2 receive the fixed focusing voltage Vfs. The first segment G5-1 of the fifth grid G5 is connected to the third segment G5-3. The first and third segments G5-1 and GS-3 receive the dynamic focusing voltage Vfd which parabolically changes depending on the electron beam deflection amount.

By applying these voltages, a first quadrupole lens having divergent action in the horizontal direction H and focusing action in the vertical direction V is formed between the first and second segments G5-1 and G5-2 of the fifth grid G5. A second quadrupole lens having focusing action in the horizontal direction H and divergent action in the vertical direction V is formed between the second and third segments G5-2 and G5-3 of the fifth grid G5.

This structure can obtain the same effects as those of the above embodiment.

Although not shown, the same effects can also be attained when noncircular electron beam apertures having a major axis in the vertical direction V are formed in the fourth grid G4.

The same effects can also be attained when noncircular electron beam apertures having a major axis in the horizontal direction H are formed in that surface of the third grid G3, which faces the fourth grid G4 and that surface of the fifth grid G5, which faces the fourth grid G4.

The same effects can also be attained when grooves are formed in the vertical direction V of electron beam apertures in that surface of the third grid G3, which faces the fourth grid G4 and that surface of the fifth grid G5, which faces the fourth grid G4.

As described above, the color cathode ray tube apparatus of the present invention comprises an electron gun assembly having cathodes and a plurality of grid electrodes laid out from the cathodes toward the phosphor screen. In the electron gun assembly, these cathodes, and first and second grids form an electron beam generator for generating an electron beam. The second and third grids form a pre-focusing lens for preliminarily focusing the electron beam from the electron beam generator. The third to fifth grids form a UPF type sub-lens for further preliminarily focusing the electron beam which was preliminarily focused by the pre-focusing lens. The fifth and sixth grids form a BPF type main lens for finally focusing the electron beam preliminarily focused by the sub-lens on the phosphor screen.

The focusing power of the sub-lens is weaker in the horizontal direction than in the vertical direction. The focusing power of the main lens is stronger in the horizontal direction than in the vertical direction.

The third grid is made up of the first and second segments laid out along the propagation direction of the electron beam. When the electron beam is not deflected, the first quadrupole lens is formed between the pre-focusing lens and sub-lens, i.e., the first and second segments of the third grid.

The fifth grid is made up of the first and second segments laid out along the propagation direction of the electron beam. When the electron beam is not deflected, the second quadrupole lens is formed between the sub-lens and main lens, i.e., the first and second segments of the fifth grid.

The fixed focusing voltage is applied to at least one segment forming the first quadrupole lens and one segment forming the second quadrupole lens. The dynamic focusing voltage which parabolically and dynamically changes in synchronism with the deflection magnetic field is applied to at least the other segment forming the first quadrupole lens and the other segment forming the second quadrupole lens. This dynamic focusing voltage parabolically changes to be lowest when the electron beam is not deflected and highest at a maximum electron beam deflection amount. As the dynamic focusing voltage gradually increases, the first quadrupole lens weakens its horizontal focusing action and vertical divergent action, and the second quadrupole lens weakens its horizontal divergent action and vertical focusing action.

This structure makes the horizontal and vertical incident angles of an electron beam landing on the phosphor screen be always equal to each other. As a result, a circular beam spot can be formed on the entire phosphor screen.

Even if the dynamic focusing voltage deviates from a predetermined voltage, the beam spot diameter hardly changes, and a stable focusing characteristic can be provided.

As has been described above, the present invention can provide a cathode ray tube apparatus having stable performance of suppressing the elliptic distortion of a beam spot on the entire phosphor screen and obtaining a good focusing characteristic on the entire phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising an electron gun assembly which has a cathode and a plurality of grid electrodes sequentially laid out from the cathode toward a phosphor screen, and emits an electron beam, and a deflection device for forming a deflection magnetic field for horizontally and vertically deflecting the electron beam emitted by said electron gun assembly, said electron gun assembly including:

an electron beam generator for generating an electron beam;

a pre-focusing lens for preliminarily focusing the electron beam emitted by said electron beam generator;

a sub-lens which has lens action with a weaker horizontal focusing power than a vertical focusing power, and further preliminarily focuses the electron beam which was preliminarily focused by said pre-focusing lens;

a main lens which has lens action with a stronger horizontal focusing power than a vertical focusing power, and focuses the electron beam preliminarily focused by said sub-lens on the phosphor screen; and voltage application means for applying to each grid electrode of said electron gun assembly a voltage which forms first and second multipole lenses between said pre-focusing lens and said main lens when the electron beam emitted by said electron gun assembly is not deflected and is focused on a center of the phosphor screen, and weakens lens actions of the first and second multipole lenses with an increase in electron beam deflection amount when the electron beam is deflected.

2. An apparatus according to claim 1, wherein the first multipole lens has focusing action in the horizontal direction and divergent action in the vertical direction, and the second multipole lens has divergent action in the horizontal direction and focusing action in the vertical direction.

3. An apparatus according to claim 1, wherein the first multipole lens has divergent action in the horizontal direction and focusing action in the vertical direction, and the second multipole lens has focusing action in the horizontal direction and divergent action in the vertical direction.

4. An apparatus according to claim 1, wherein said voltage application means applies a voltage which dynamically changes in synchronism with the deflection magnetic field, to at least one grid electrode forming the first multipole lens, at least one grid electrode forming the second multipole lens, and at least one grid electrode forming said main lens.

5. An apparatus according to claim 4, wherein the voltage applied by said voltage application means minimizes to form a maximum potential difference with a voltage applied to an adjacent grid electrode when the electron beam is not deflected, and increases with an increase in electron beam deflection amount to form a minimum potential difference with the voltage applied to the adjacent grid electrode at a maximum electron beam deflection amount when the electron beam is deflected.

6. An apparatus according to claim 5, wherein said voltage application means applies at the maximum electron beam deflection amount a voltage which makes the lens actions of the first and second multipole lenses disappear.

7. An apparatus according to claim 1, wherein the first multipole lens is formed between said pre-focusing lens and said sub-lens, and the second multipole lens is formed between said sub-lens and said main lens.

8. An apparatus according to claim 1, wherein the first and second multipole lenses are formed between said sub-lens and said main lens.

9. An apparatus according to claim 1, wherein said electron gun assembly comprises a first grid, a second grid, a first segment of a third grid, a second segment of the third grid, a fourth grid electrically connected to the second grid, a first segment of a fifth grid electrically connected to the first segment of the third grid, a second segment of the fifth grid electrically connected to the second segment of the third grid, and a sixth grid, which are sequentially laid out from the cathode toward the phosphor screen, and said voltage application means applies a voltage so as to form the first multipole lens between the first and second segments of the third grid, said sub-lens between the second segment of the third grid and the first segment of the fifth grid, the second multipole lens between the first and second segments of the fifth grid, and said main lens between the second segment of the fifth grid and the sixth grid when the electron beam is not deflected.

10. An apparatus according to claim 1, wherein said electron gun assembly comprises a first grid, a second grid, a first segment of a third grid, a second segment of the third grid, a fourth grid electrically connected to the second grid, a first segment of a fifth grid electrically connected to the second segment of the third grid, a second segment of the fifth grid electrically connected to the first segment of the third grid, and a sixth grid, which are sequentially laid out from the cathode toward the phosphor screen, and said voltage application means applies a voltage so as to form the first multipole lens between the first and second segments of the third grid, said sub-lens between the second segment of the third grid and the first segment of the fifth grid, the second multipole lens between the first and second segments of the fifth grid, and said main lens between the second segment of the fifth grid and the sixth grid when the electron beam is not deflected.

11. An apparatus according to claim 1, wherein said electron gun assembly comprises a first grid, a second grid, a third grid, a fourth grid electrically connected to the second grid, a first segment of a fifth grid, a second segment of the fifth grid electrically connected to the third grid, a third segment of the fifth grid electrically connected to the first segment of the fifth grid, and a sixth grid, which are sequentially laid out from the cathode toward the phosphor screen, and said voltage application means applies a voltage so as to form said sub-lens between the third grid and the first segment of the fifth grid, the first multipole lens between the first and second segments of the fifth grid, the second multipole lens between the second and third segments of the fifth grid, and said main lens between the third segment of the fifth grid and the sixth grid when the electron beam is not deflected.

* * * * *